US009926685B1

(12) United States Patent
Reinert

(10) Patent No.: US 9,926,685 B1
(45) Date of Patent: Mar. 27, 2018

(54) ADJUSTABLE COUPLER FOR WORK IMPLEMENT

(71) Applicant: Pengo Corporation, Laurens, IA (US)

(72) Inventor: Michael J. Reinert, Ruthvin, IA (US)

(73) Assignee: Pengo Corporation, Laurens, IA (US)

( * ) Notice: Subject to any disclaimer, the term of this patent is extended or adjusted under 35 U.S.C. 154(b) by 0 days.

(21) Appl. No.: 15/583,531

(22) Filed: May 1, 2017

(51) Int. Cl.
*E02F 3/96* (2006.01)
*E21B 7/02* (2006.01)

(52) U.S. Cl.
CPC ..... *E02F 3/963* (2013.01); *E21B 7/028* (2013.01)

(58) Field of Classification Search
CPC ..... E02F 3/3636; E02F 3/369; E02F 3/307; E02F 3/30; E02F 3/3686; E02F 3/3609; E02F 3/3604; E02F 3/963
See application file for complete search history.

(56) References Cited

U.S. PATENT DOCUMENTS 3,746,104 A * 7/1973 McIntosh ..... E21C 27/28 173/193
4,199,033 A * 4/1980 Van Gundy, Jr. ..... E02F 3/3677 173/192
4,542,929 A * 9/1985 Possinger ..... B66C 3/16 294/198
4,639,183 A * 1/1987 Guthoff ..... E02F 3/364 37/443
4,906,161 A * 3/1990 Weyer ..... E02F 3/345 37/403
4,955,779 A 9/1990 Knackstedt
5,145,313 A * 9/1992 Weyer ..... E02F 3/3618 37/468
5,195,865 A * 3/1993 Koehl ..... E02F 3/3636 172/40
5,556,217 A * 9/1996 Deyo ..... E02F 3/3604 173/185
5,938,399 A * 8/1999 Knutson ..... E02F 3/3681 37/468
5,950,735 A * 9/1999 Godbersen ..... A01B 59/062 172/439
6,874,583 B2 * 4/2005 Wood, Jr. ..... A01B 59/06 172/439
6,938,514 B1 9/2005 Crane
7,779,562 B1 * 8/2010 Loveless ..... E02F 3/3627 37/231

(Continued)

FOREIGN PATENT DOCUMENTS

GB 2410777 8/2005

*Primary Examiner* — Daniel J Wiley
(74) *Attorney, Agent, or Firm* — Nyemaster Goode, PC

(57) ABSTRACT

An adjustable coupler includes a frame, a first bracket, and a second bracket. One or both of the first bracket and the second bracket are slidably combined with the frame along a slot formed in the frame. A fastener extends from each bracket and is received into the slot allowing the bracket to slide along the frame. The fastener also serves to securely fasten the bracket to the frame after it is moved to its desired position. The slidable engagement of the brackets with the frame allows the distance between the brackets to be selectively changed allowing them to be secured to different types and sizes of mobile attachment devices. The frame further includes an attachment opening adapted to receive a pin for connecting a motor or prime mover vehicle with the adjustable coupler.

24 Claims, 11 Drawing Sheets

(56) References Cited

U.S. PATENT DOCUMENTS

| | | | | |
|---|---|---|---|---|
| 7,832,130 | B2 * | 11/2010 | Sederberg | E02F 3/3604 37/403 |
| 8,544,562 | B2 * | 10/2013 | Weyer | E02F 3/3663 173/218 |
| 8,585,327 | B2 * | 11/2013 | Thurner | E02D 7/02 405/184.4 |
| 8,687,697 | B2 | 3/2014 | Monaghan | |
| 8,936,428 | B1 * | 1/2015 | Page | B66F 9/18 37/403 |
| 9,726,218 | B2 * | 8/2017 | Hoffmans | F16C 11/10 |
| 2007/0134081 | A1 * | 6/2007 | Seabolt | E02F 3/08 414/723 |
| 2016/0356339 | A1 * | 12/2016 | Park | E02F 5/326 |

* cited by examiner

ADJUSTABLE COUPLER FOR WORK IMPLEMENT

BACKGROUND

The invention generally relates to an adjustable coupler for connecting a mobile attachment implement such as an auger to a prime mover vehicle such as a skid-steer loader.

Mobile construction and land clearing devices are used in a wide range of industries for many different purposes. Examples of land clearing devices include mowers, soil conditioners, wood chippers, stump grinders, and brush cutters. Examples of mobile construction devices include earth augers, buckets, sweepers, and rock saws. Collectively, land clearing and mobile construction devices are sometimes referred to herein as mobile attachment devices. These mobile attachment devices are typically attachment implements mounted to a prime mover such as a tractor, excavator, or skid steer loader.

Mobile attachment devices are removably combined with prime mover vehicles by coupling assemblies. Typically, each mobile attachment device is provided with an opening or female coupling structure, which is welded to implement. The motor or prime mover vehicle also includes an opening or female coupling structure. A male coupling structure such as a pin is selectively inserted through both openings to secure the mobile attachment device to the prime mover vehicle. When the male coupling structure is coupled to the female coupling structures, the implement may be selectively lifted and lowered, by means of the load-lifting arms, and may be selectively tilted, by means of the load-tilting pistons. It is known to employ pins, wedges, or similar components to latch the male coupling structure releasably to the female coupling structures so that the male coupling structure does not inadvertently detach from the female couplings. One problem with existing coupling assemblies is that different mobile attachment devices and different prime mover vehicles often use different types and sizes of coupling assemblies. Thus, users are required to purchase and carry multiple couplers for using the same implement with different brands of prime movers or different implements with the same prime mover.

There is therefore a need for a mounting assembly having adjustable components so it can be used to connect multiple types of mobile attachment devices to multiple types of prime mover vehicles.

SUMMARY

Although different types of mobile attachment devices can be used with the adjustable coupler assembly that is the subject of this invention, for simplicity, the disclosure will describe the invention using augers as an exemplary mobile attachment device.

In one aspect of the invention, an adjustable coupler assembly includes a frame, a first bracket, and a second bracket. At least one of the first bracket and the second bracket is slidably combined with the frame along an elongated opening such as a slot or track formed in the frame. At least one guide member extends from each bracket and into the elongated opening to allow the slidable connection and also to secure the bracket to the frame after it is moved to its desired position. The slidable engagement of the bracket(s) with the frame allows the distance between the brackets to be selectively changed allowing them to be secured to different types and sizes of attachment assemblies, such as a mobile attachment device or the boom of a prime mover vehicle. The brackets include an attachment means such as attachment openings adapted to receive one or more members such as pins for securing an attachment assembly between the brackets after the brackets have been properly positioned along the frame. The frame further includes an attachment means such as an opening adapted to receive an attachment member such as a pin for connecting to another attachment assembly. In this manner, the adjustable coupler assembly connects a prime mover vehicle to a mobile attachment device.

In another aspect of the invention, an adjustable coupler assembly includes a frame, a first bracket, and a second bracket. Each bracket includes a bottom plate and an ear portion extending upwardly therefrom. The bracket further includes at least one side plate which may be combined with the bottom plate and the ear portion in some embodiments to help support those components relative to each other. The frame includes a first rail combined with a second rail. The rails extend in different directions and may be combined at about a right angle in one embodiment. Each of the rails includes elongated openings such as tracks or slots which are adapted to receive guide members extending from the brackets. The first and second bracket are each slidably combined with the frame along the elongated openings so that guide members extending from the openings in the brackets are received by and slide within elongated openings. The slidable engagement of the brackets with the frame allows the distance between the brackets to be selectively changed allowing them to be secured to different types and sizes of attachment assemblies, such as a mobile attachment device or the boom of a prime mover vehicle. The guide members are tightened to secure the brackets to the frame once they are properly positioned. The brackets include an attachment means such as attachment openings adapted to receive one or more members such as pins for securing a mobile attachment device between the brackets after the brackets have been properly positioned along the frame. The frame further includes an attachment means such as an opening adapted to receive an attachment member such as a pin for connecting to another attachment assembly.

In another aspect of the invention, an adjustable coupler assembly includes a frame adapted to be combined with a first bracket, a second bracket, a third bracket, and a fourth bracket. Each bracket includes a bottom plate and an ear portion extending upwardly therefrom. Each bracket further includes at least one side plate which may be combined with the bottom plate and the ear portion in some embodiments to help support those components relative to each other. The first and second brackets comprise a first bracket pair and the third and fourth brackets comprise a second bracket pair. The frame includes a first rail, a second rail, and a third rail. The first rail extends in a first direction and the third rail extends in a second direction. The first and third rails are not combined with each other, instead, the first and third rails are each combined with the second rail. In one embodiment, the first and third rails are spaced apart and generally parallel. They are separated by the second rail so that the frame has a stair-step or "Z" shape. Each of the three rails includes elongated openings such as tracks or slots which are adapted to receive guide members such as fasteners from the brackets bottom plate and side plate. The first and second bracket are each slidably combined and extend from the frame in a first direction. Fasteners extending from the openings in the first and second brackets engage the first and second rails of the frame and are tightened to secure the brackets in place once they are properly positioned. The third and fourth brackets are each slidably combined and extend from the frame in a second direction. Fasteners extending from the openings in the third and fourth brackets engage the second and third rails of the frame and are tightened to secure the brackets in place once they are properly positioned. The slidable engagement of the brackets with the frame allows the distance between each pair of brackets to be selectively changed to combine with different types and sizes of prime mover vehicles and mobile attachment devices. The first bracket pair includes an attachment means such as attachment openings adapted to receive one or more members such as pins for securing a mobile attachment device between the brackets after the brackets have been properly positioned along the frame. The second bracket pair includes an attachment means such as attachment openings adapted to receive one or more members such as pins for securing a motor or prime mover vehicle between the brackets after the brackets have been properly positioned along the frame.

In another aspect of the invention, a method of using one of the adjustable coupler assemblies described above. The method includes taking one of the adjustable coupler assemblies described above. Then, a proper distance between the brackets is determined by measuring the length of the pin or the distance between pins on one of the mobile attachment device and the prime mover vehicle. In one embodiment, the measurement is taken at the pin end of the prime mover vehicle's boom/arm wherein the distance between the brackets is typically the width of the boom/arm at the pin so that each bracket is positioned on opposite outside surfaces of the stick/arm. The brackets are adjusted to that width and secured before the mount is connected to the prime mover. The brackets are adjusted by loosening the fasteners then sliding one or both brackets along the frame's opening/track until they are the proper distance apart where the brackets are secured in place by tightening the fasteners. The pin(s) from the prime mover vehicle's attachment assembly is (are) then secured through the openings in the brackets. The pin(s) from the mobile attachment device is (are) secured through other openings in the frame so that the coupling assembly attaches the mobile attachment device to the prime mover vehicle. The assembly is attached to the mobile attachment device either before or after the assembly is attached to the prime mover vehicle.

DETAILED DESCRIPTION

Figure 9:
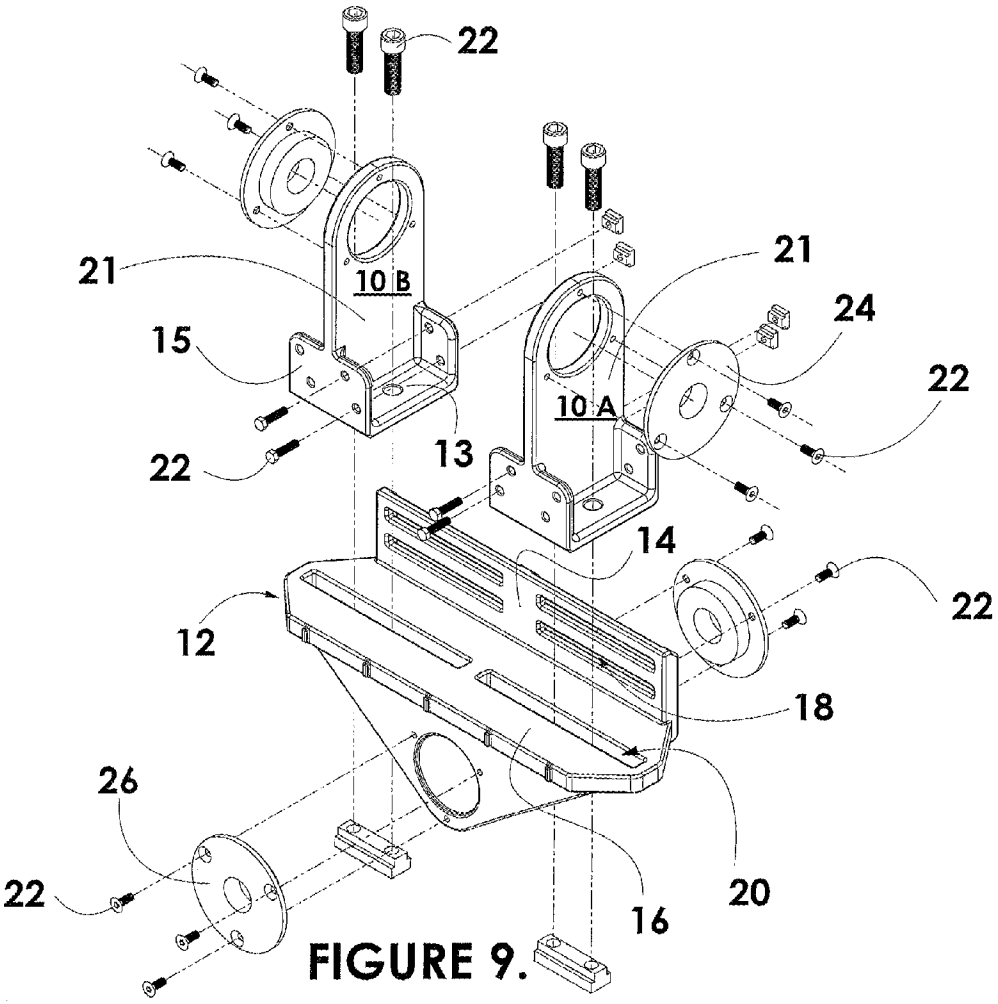
FIG. 9 is an exploded view of the embodiment shown in FIG. 1.

FIGS. 1-5 and 9 show a first embodiment of the invention wherein the adjustable coupler assembly includes a frame 12, a first bracket 10A, and a second bracket 10B. Each bracket 10A, 10B includes a bottom plate 13 and at least one ear member 21 extending upwardly therefrom. Each bracket 10A, 10B further includes a side plate 15 combined with one or both of the bottom plate 13 and the ear member 21. The frame 12 includes a first rail 14 combined with a second rail 16. The rails 14, 16 extend in different directions and may be combined at about a right angle in one embodiment. In other embodiments the rails 14, 16 are combined at an angle between about seventy and one hundred and ten degrees. Each of the rail portions 14, 16 may be generally planer and include elongated openings 18, 20 such as tracks or slots which are adapted to receive the fasteners 22 from the brackets 10A, 10B and allow guide members such as fasteners 22 to slide within the openings 18, 20 to provide an infinite adjustment between the brackets 10A, 10B. In the embodiment shown, the plates 13, 15 include openings adapted to receive the fasteners 22. Any suitable fastener 22 can be used. In one embodiment two fasteners 22 extend from the first plate 13 of each bracket 10A, 10B into the first rail 14 and two fasteners 22 extend from the second plate 15 of each bracket 10A, 10B into the second rail 16. The fasteners 22 may be bolts secured by nuts, t-nuts, or t-slot nuts as shown in FIG. 9. T-nuts and t-slot nuts include a nut portion having a varied width so that a portion of the nut is received into the slot 18, 20. This helps the brackets 10A, 10B slide within the slots 18, 20 and also helps prevent the nut from turning after it is tightened. A portion of the nut is wider than the slot 18, 20 so that the nut cannot pass all the way through the slot 18, 20. In one embodiment, one or both of the rail portions 14, 16 includes two generally parallel elongated openings 18, 20.

In some embodiments, only one of the brackets 10A is movable relative to the frame 12 while the other bracket 10B remains fastened to the frame 12 in a stationary position. In this manner, the distance between the brackets 10A, 10B can be adjusted by moving the slidable bracket 10A relative to the stationary bracket 10B. In some embodiments the movable bracket(s) 10A, 10B is (are) only slidably combined with the elongated openings 18, 20 in one of the first rail 14 and the second rail 16. In the embodiments shown, however, the movable bracket(s) 10A, 10B is (are) combined with both of the rail portions 14, 16. Combining the brackets 10A, 10B to both rail portions 14, 16 of the frame 12 provides additional strength and stability and helps ensure the brackets 10A, 10B are securely combined to the frame 12.

Figure 2:
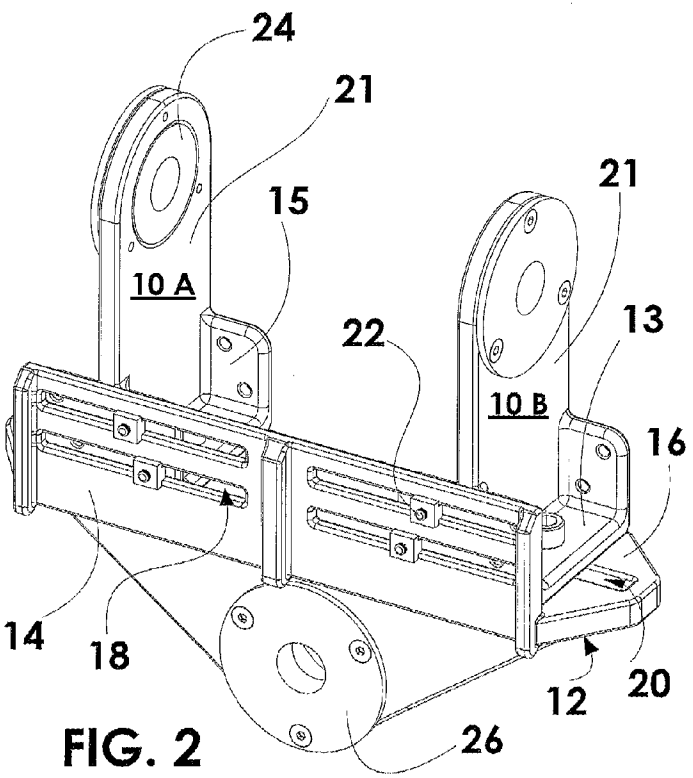
FIG. 2 is a perspective view of the embodiment shown in FIG. 1 showing a second side of the assembly.
Figure 1:
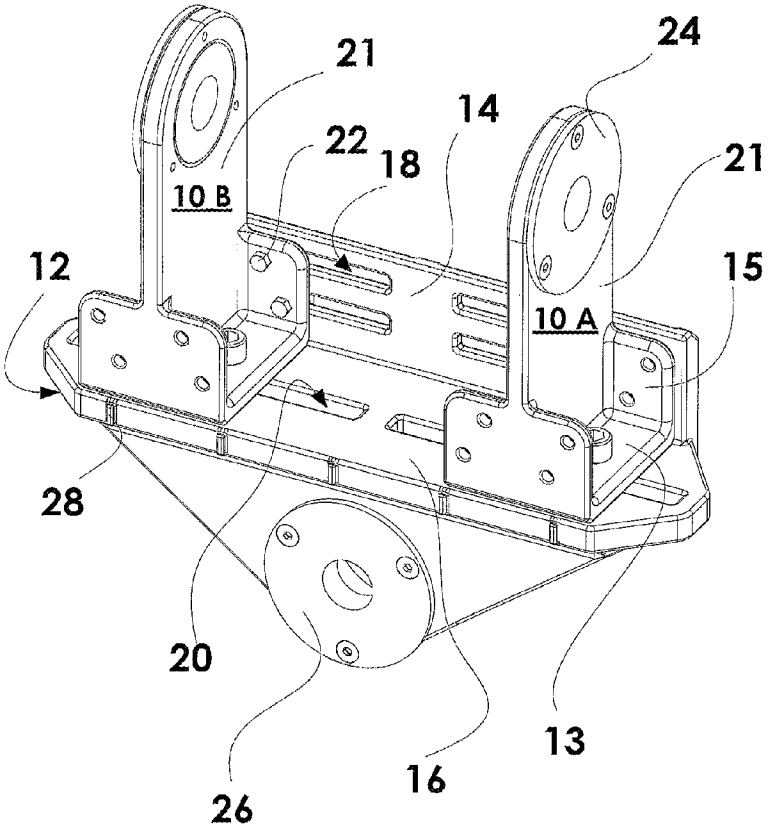
FIG. 1 is a perspective view of one embodiment of the adjustable coupler assembly showing a first side of the assembly.
Figure 4:
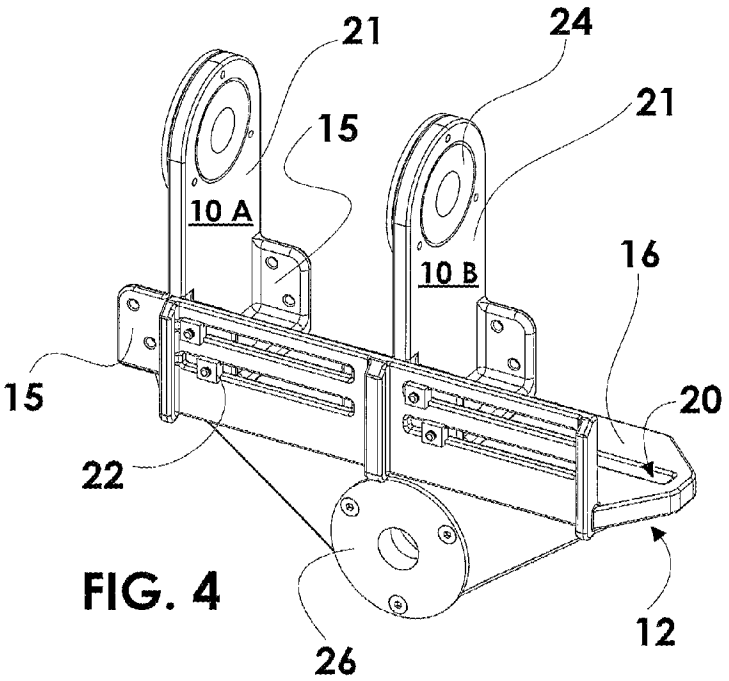
FIG. 4 is a perspective view of the embodiment shown in FIG. 1 where one of the brackets has been turned around to provide an off-set.
Figure 3:
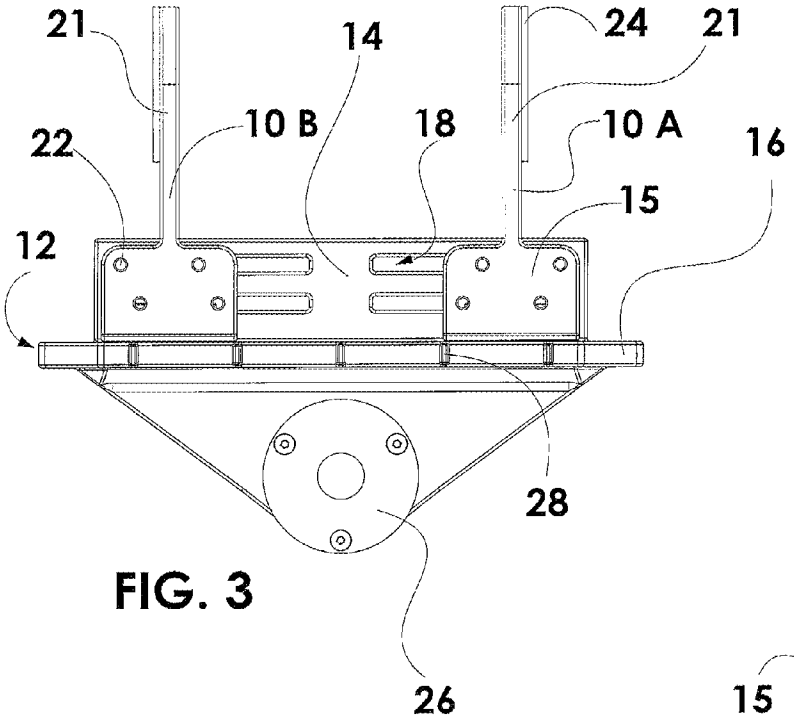
FIG. 3 is a side view of the embodiment shown in FIG. 1.
Figure 5:
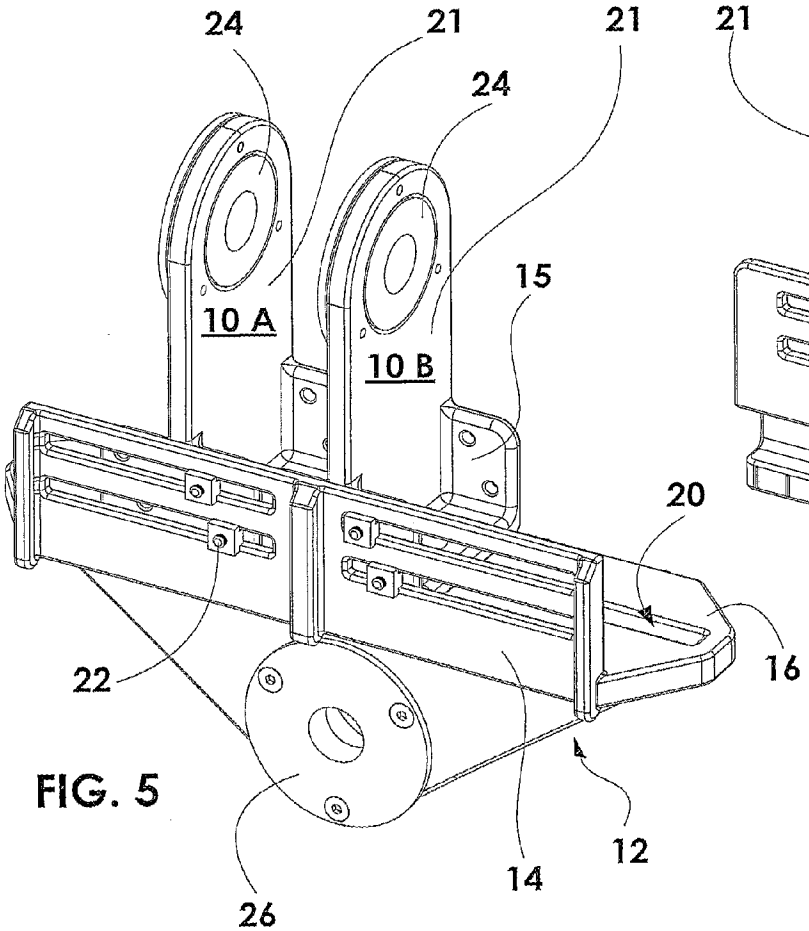
FIG. 5 is a perspective view of the embodiment shown in FIG. 1 where one of the brackets has been turned around to provide an off-set.
Figure 16:
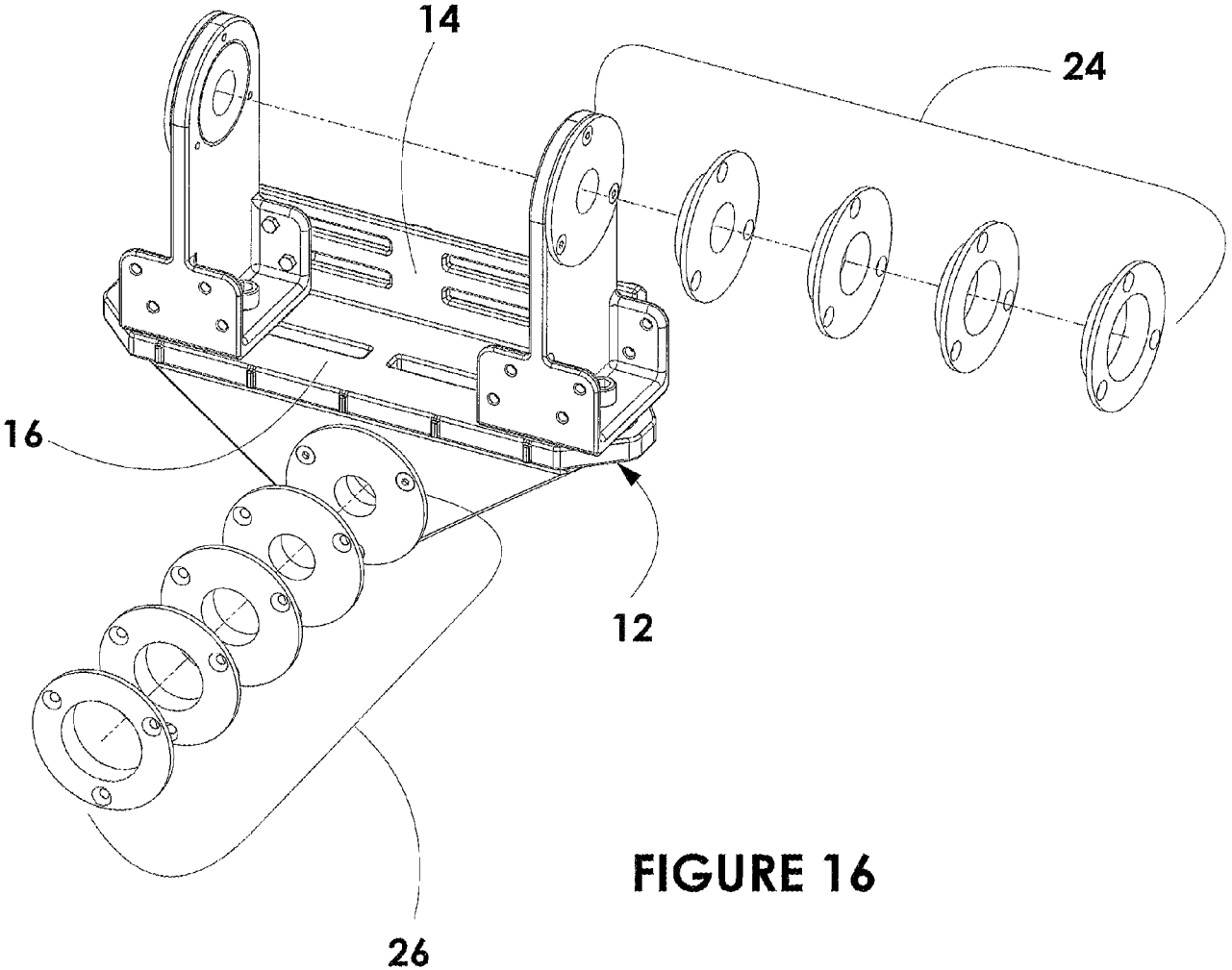
FIG. 16 is a perspective showing that different sized bushings may be used with the assembly.

The slidable engagement of the brackets 10A, 10B with the frame 12 allows the distance between the brackets 10 to be changed without detaching the brackets 10A, 10B from the frame 12. This allows the adjustable coupler assembly to combine with different types and sizes of mobile attachment devices and prime mover vehicles. FIGS. 1-3 show the brackets 10A, 10B in a first position where they are each moved toward opposite ends of the frame 12 to provide a first distance between them. The visual markings 28 on the frame 12 may be used to help determine the distance between the brackets 10A, 10B and also to help determine whether each bracket 10A, 10B is the same distance from the center of the frame 12. FIG. 4 shows the brackets 10 in a second position where bracket 10B has been moved toward the center of the frame 12 to close the distance between the brackets 10 and provide an offset where the implement can be secured to the frame 12 in an off-center position. FIG. 5 shows a third position where both brackets 10 have been moved toward the center of the frame 12. After the brackets 10A, 10B have been moved to their desired position, the fasteners 22 are tightened to secure the brackets 10A, 10B to the frame 12. In the embodiments shown, openings in the ear portions 21 of the brackets 10A, 10B are adapted to receive a pin or other fastener to secure to the attachment assembly of a first object such as a prime mover vehicle or mobile attachment device thereto. As shown in FIG. 16, the openings in the ear portions 21 of the brackets 10A, 10B include interchangeable bushings 24 having different sized openings to help secure different sized pins/fasteners. In other embodiments the brackets 10A, 10B may include a pin adapted to be connected to openings in the attachment assembly of the first object. The frame 12 further includes an opening adapted to receive an attachment member such as a pin for connecting to the attachment assembly of a second object such as a prime mover vehicle or mobile attachment device (whichever is not connected to the brackets 10A, 10B) with the adjustable coupler. As shown in FIG. 16, the opening in the frame 12 includes interchangeable bushings 26 having different sized openings to help secure different sized pins/fasteners. In other embodiments, the frame 12 may include a pin adapted to be connected to openings in the attachment assembly of the second object.

Figure 6:
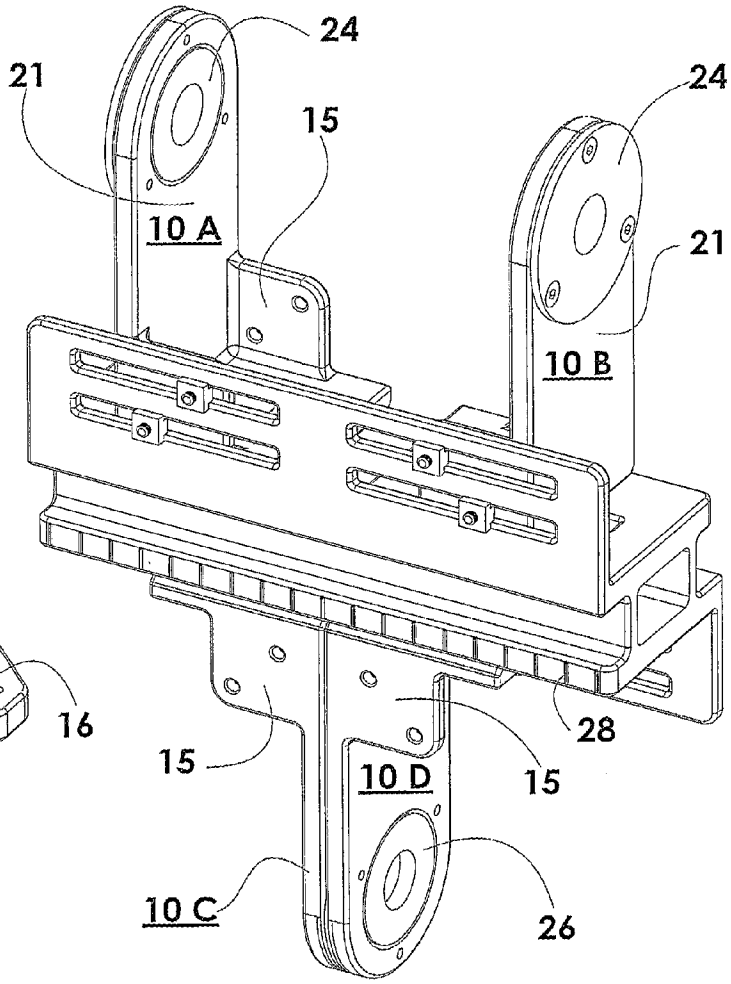
FIG. 6 is a perspective view of another embodiment of the adjustable coupler assembly showing a first side of the assembly.
Figure 8:
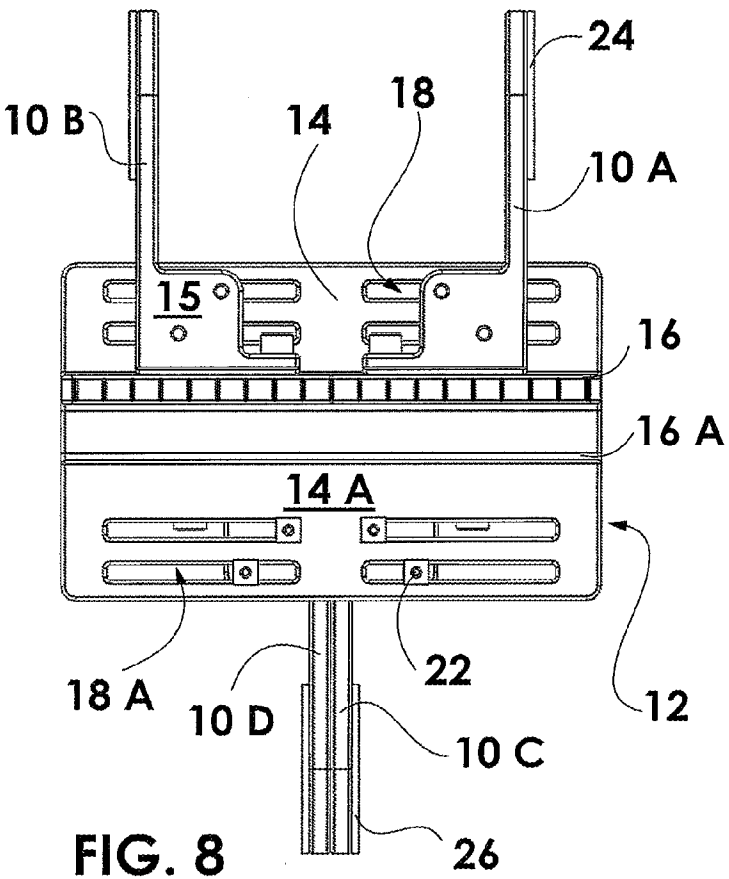
FIG. 8 is a side view of the embodiment shown in FIG. 6.
Figure 7:
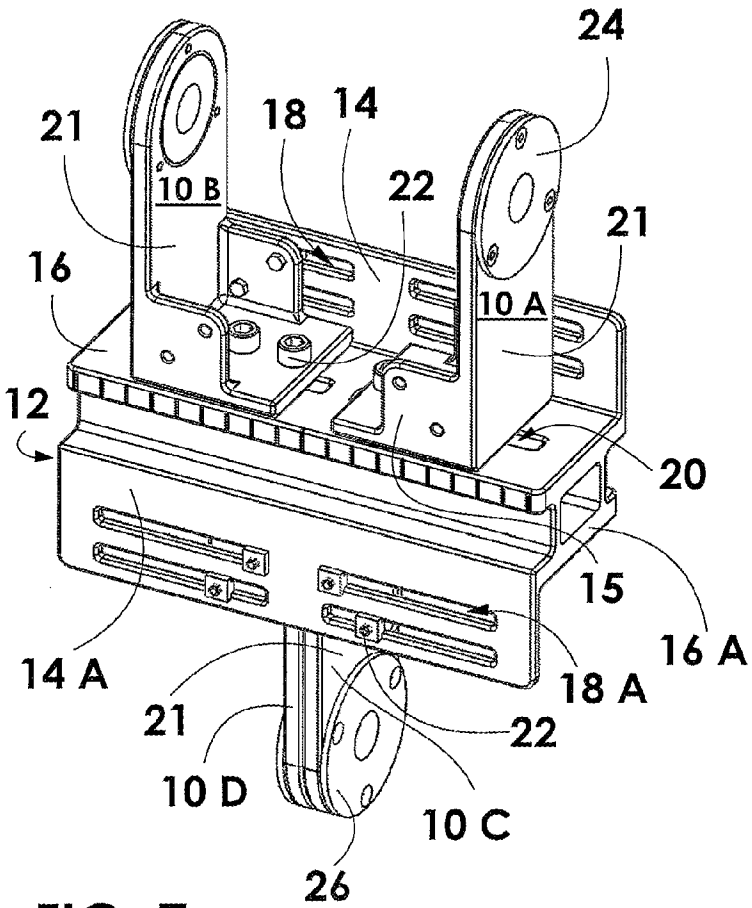
FIG. 7 is a perspective view of the embodiment shown in FIG. 6 showing a second side of the assembly.

Another embodiment is shown in FIGS. 6-8 wherein an adjustable coupler assembly includes a frame 12 adapted to be combined with a first bracket 10A, a second bracket 10B, a third bracket 10C, and a fourth bracket 10D. The features described above also apply to this embodiment. Each bracket 10A-10D includes a bottom plate 13 and an ear portion 21 extending upwardly therefrom and a side plate 15 combined with one or both of the bottom plate 13 and the ear portion 21. Each of the plates 13, 15 includes openings adapted to receive guide members such as fasteners 22. The first and second brackets 10A, 10B comprise a first bracket pair and the third and fourth brackets 10C, 10D comprise a second bracket pair. In some embodiments only one of the brackets in each bracket pair is movable while the other remains fixed to the frame 12. In this manner, the distance between the brackets can be changed by moving the movable bracket relative to the fixed bracket.

As best shown in FIGS. 6 and 7, the frame 12 includes a first rail 14, a second rail 16, and a third rail 14A. The first rail 14 extends in a first direction and the third rail 14A extends in a second direction. The first and third rails 14, 14A are not combined with each other, instead, the first and third rails 14, 14A are each combined with the second rail 16. In one embodiment, the first and third rails 14, 14A are spaced apart and generally parallel. They are separated by the second rail 16 so that the frame 12 and planer portions 14, 14A, 16 have a stair-step or "Z" shape. Each of the three planer portions 14, 14A, 16 includes elongated openings 18, 18A, 20 such as tracks or slots which are adapted to receive fasteners 22 extending from the brackets 10A-10D bottom plate 13 and/or side plate 15. The ear portions 21 of the first bracket pair include openings adapted to receive one or more attachment members for securing a prime mover vehicle between the brackets 10A, 10B after the brackets 10A, 10B have been properly positioned. The ear portions 21 of the second bracket pair 10C, 10D includes openings adapted to receive an attachment member such as a pin for connecting a mobile attachment device.

FIGS. 6 and 7 show that the second rail connecting the first and third rails 14, 14A may include a first member 16 and a second member 16A. The first member 16 is combined with the first rail 14 and the second member 16A is combined with the third rail 14A. In one embodiment, the first rail 14 and first member 16 comprise a first "L" shaped component and the third rail 14A and second member 16A comprise a second "L" shaped component. The two "L" shaped components may be generally identical in construction. They are combined along their bottom surface with the first and third planer portions 14, 14A on opposite outer edges and facing opposite directions. The two portions 16, 16A that comprise the second rail are generally parallel and may be spaced apart a short distance in some embodiments. The spacing may be enough to allow the fasteners 22 extending from the bottom plate 13 of the first and second brackets 10A, 10B to not contact the fasteners 22 extending from the bottom plate 13 of the third and fourth brackets 10C, 10D as the respective fasteners 22 are moved within their respective slots 20.

As shown in FIGS. 6-8, the first and second bracket 10A, 10B are each slidably combined and extend from the frame 12 in a first direction. Fasteners 22 extending from the openings in the first and second brackets 10A, 10B engage the first and second rails of the frame 12 and are tightened to secure the brackets 10A, 10B in place once they are properly positioned. The third and fourth brackets 10C, 10D are each slidably combined and extend from the frame 12 in a second direction. Fasteners 22 extending from the openings in the third and fourth brackets 10C, 10D engage the second and third rails 14A, 16 of the frame and are tightened to secure the brackets 10C, 10D in place once they are properly positioned. The slidable engagement of the brackets 10A-10D with the frame allow the distance between each pair of brackets to be selectively changed to combine with different types and sizes of prime mover vehicles and mobile attachment devices.

Figure 10:
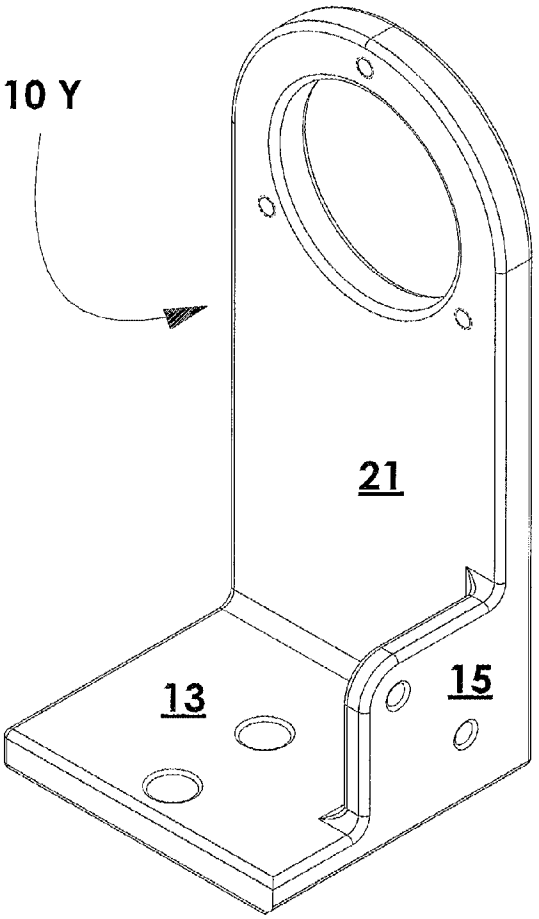
FIG. 10 is a perspective view of one embodiment of a bracket.
Figure 11:
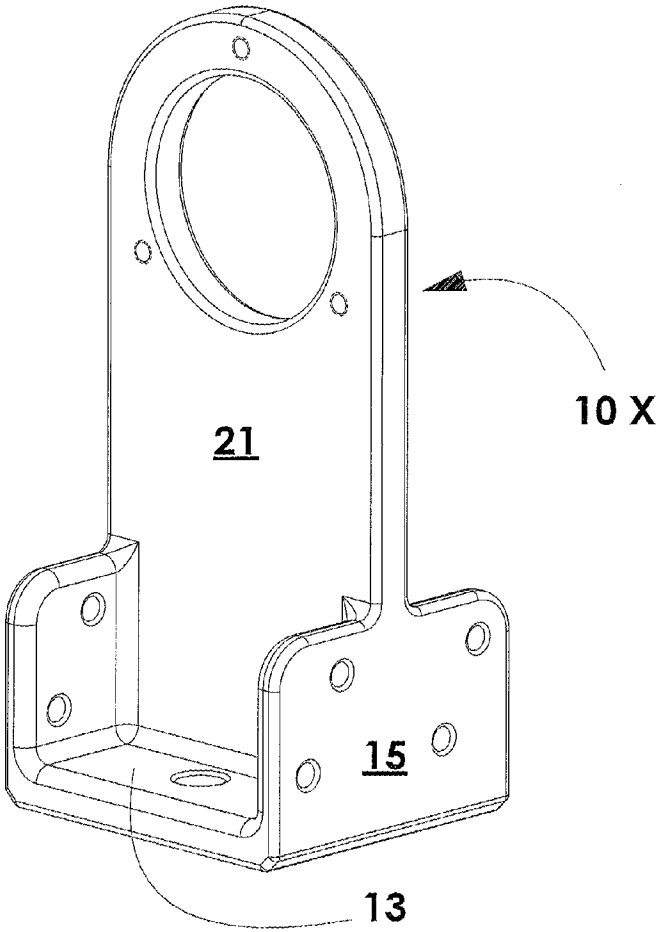
FIG. 11 is a perspective view of a second embodiment of a bracket.
Figure 12:
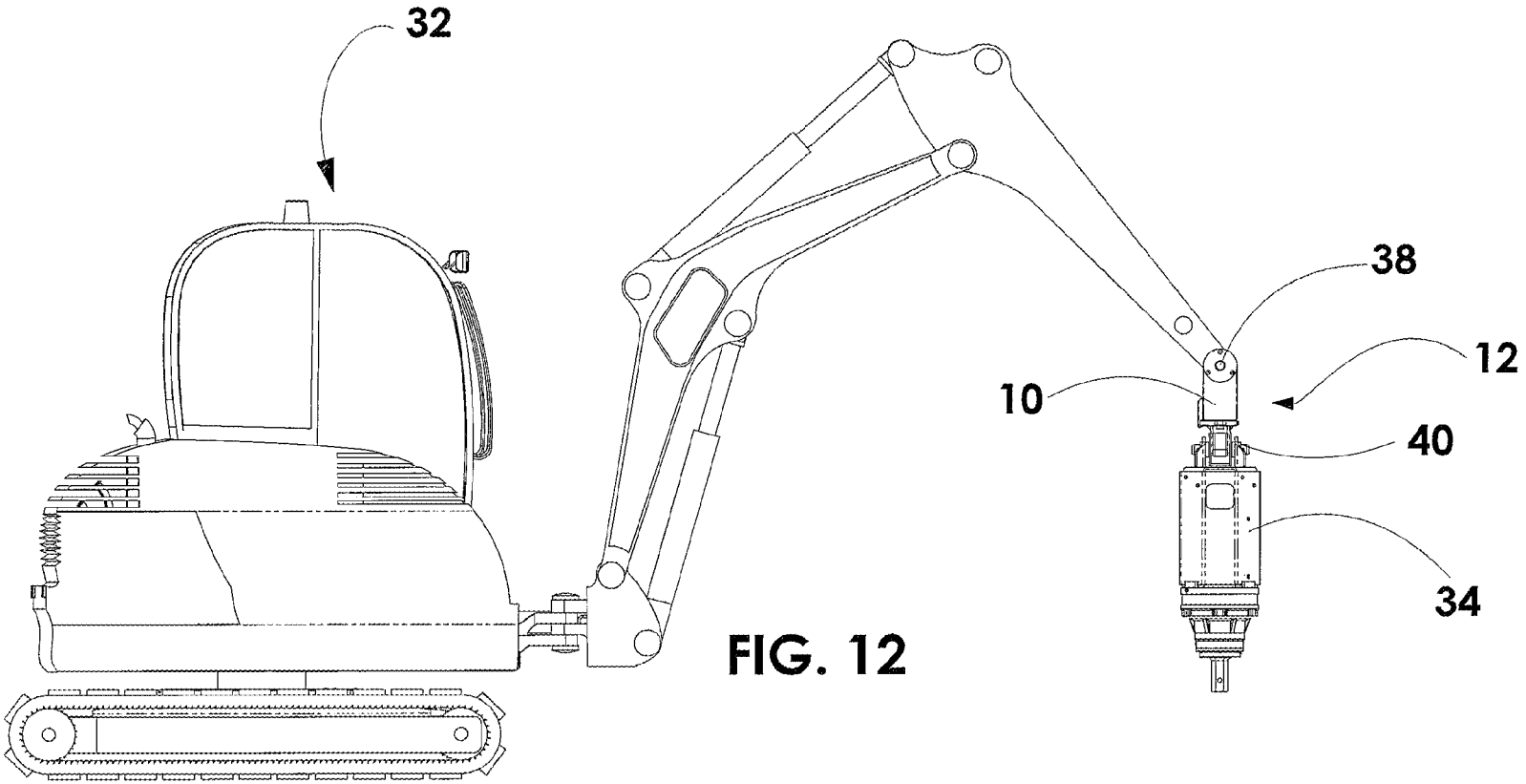
FIG. 12. is a side view of the adjustable coupler combining a prime mover to a rotary auger motor.
Figure 13:
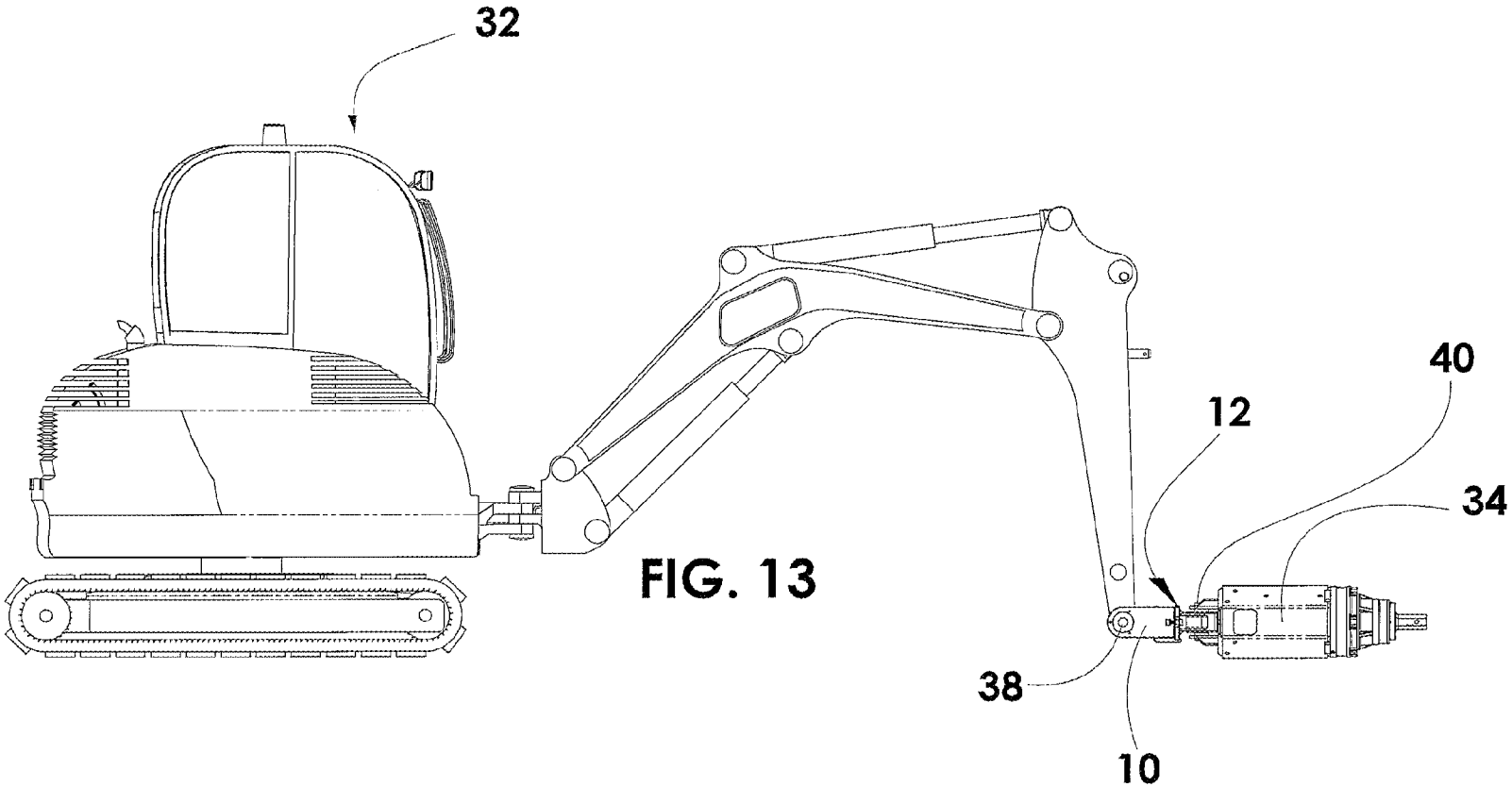
FIG. 13 is a side view of the adjustable coupler combining a prime mover to a rotary auger motor showing the coupler allows the motor to be laid flat.
Figure 15:
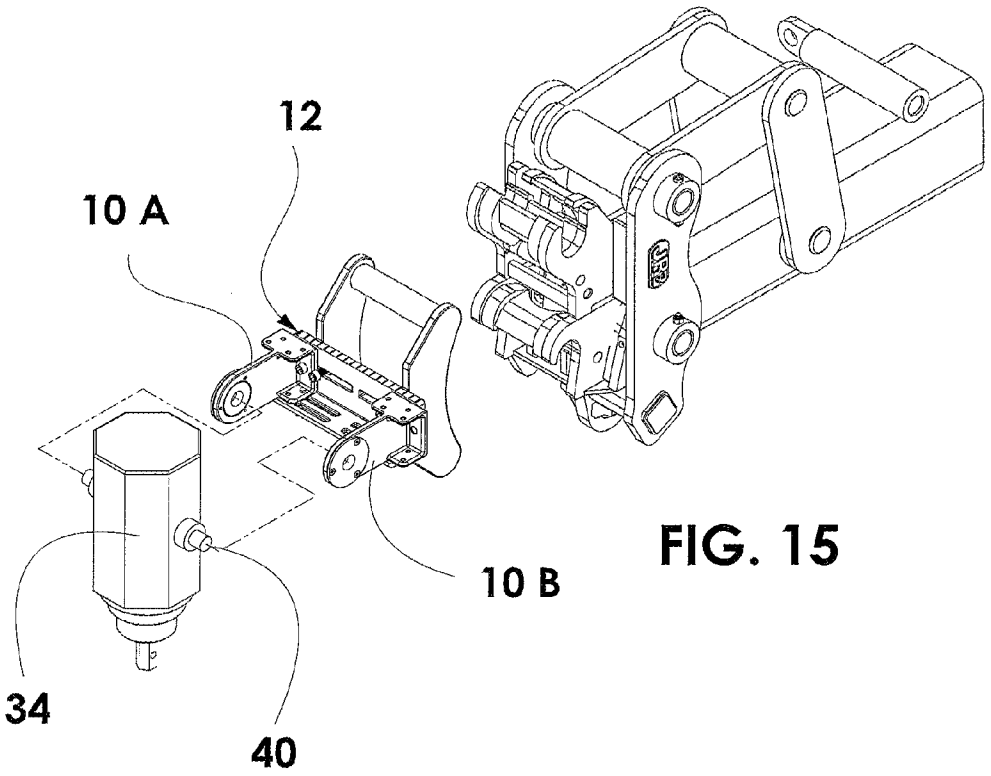
FIG. 15 is an exploded view of the coupler combining a prime mover to a rotary auger motor.
Figure 14:
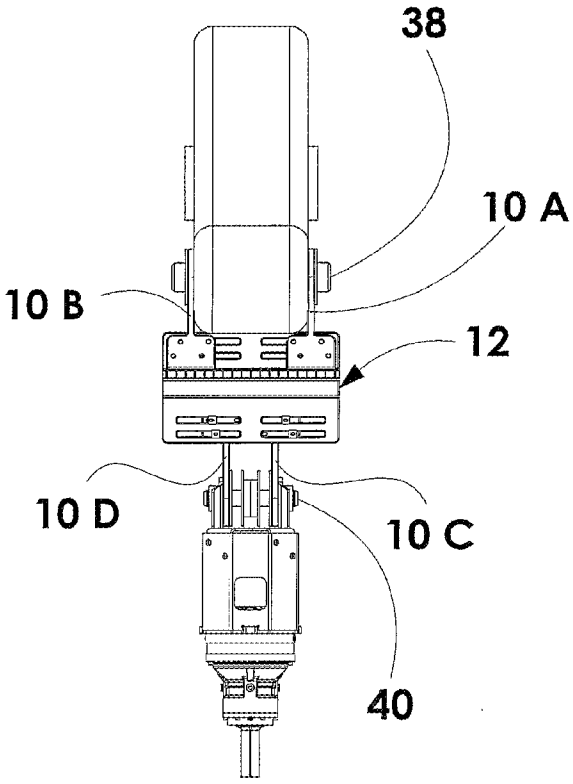
FIG. 14 is side view of the coupler combining a prime mover to a rotary auger motor.

The brackets are generally referred to herein with reference number 10 and more specifically referred to as brackets 10A, 10B, 10C, and 10D as described in the embodiments above. FIGS. 10 and 11 show different embodiments of brackets 10A-10D. The two brackets shown in FIGS. 10 and 11 are referred to herein as brackets 10X and 10Y. Any of brackets 10A-10D described above may be one of brackets 10X and 10Y. FIG. 10 shows a bracket 10Y wherein the ear portion 21 extends generally upward from one side of a base portion 13. The side member 15 is combined with the ear portion 21 and the base portion 13 to help provide structural support. Openings in the side member 15 are adapted to receive fasteners 22 as described above. FIG. 11 shows bracket 10X wherein the ear portion 21 extends generally upward from a middle portion of the base portion 13. The side member 15 is combined with the ear portion 21 and the base portion 13, however, the side member 15 extends on either side of the ear portion 21 and has openings on both sides of the ear portion 21. The bracket 10X also includes two side members 15, one on either sides of the ear portion 21 to provide additional structural support and to allow the bracket 10X to be placed on the frame 12 in either direction. This is illustrated in FIG. 4 wherein bracket 10B has been turned around to face a direction opposite the direction it is facing in FIG. 3. When the bracket 10B is turned around, the side plate 15 on the opposite side of the ear portion 21 is secured to the first frame portion 14.

Figure 17:
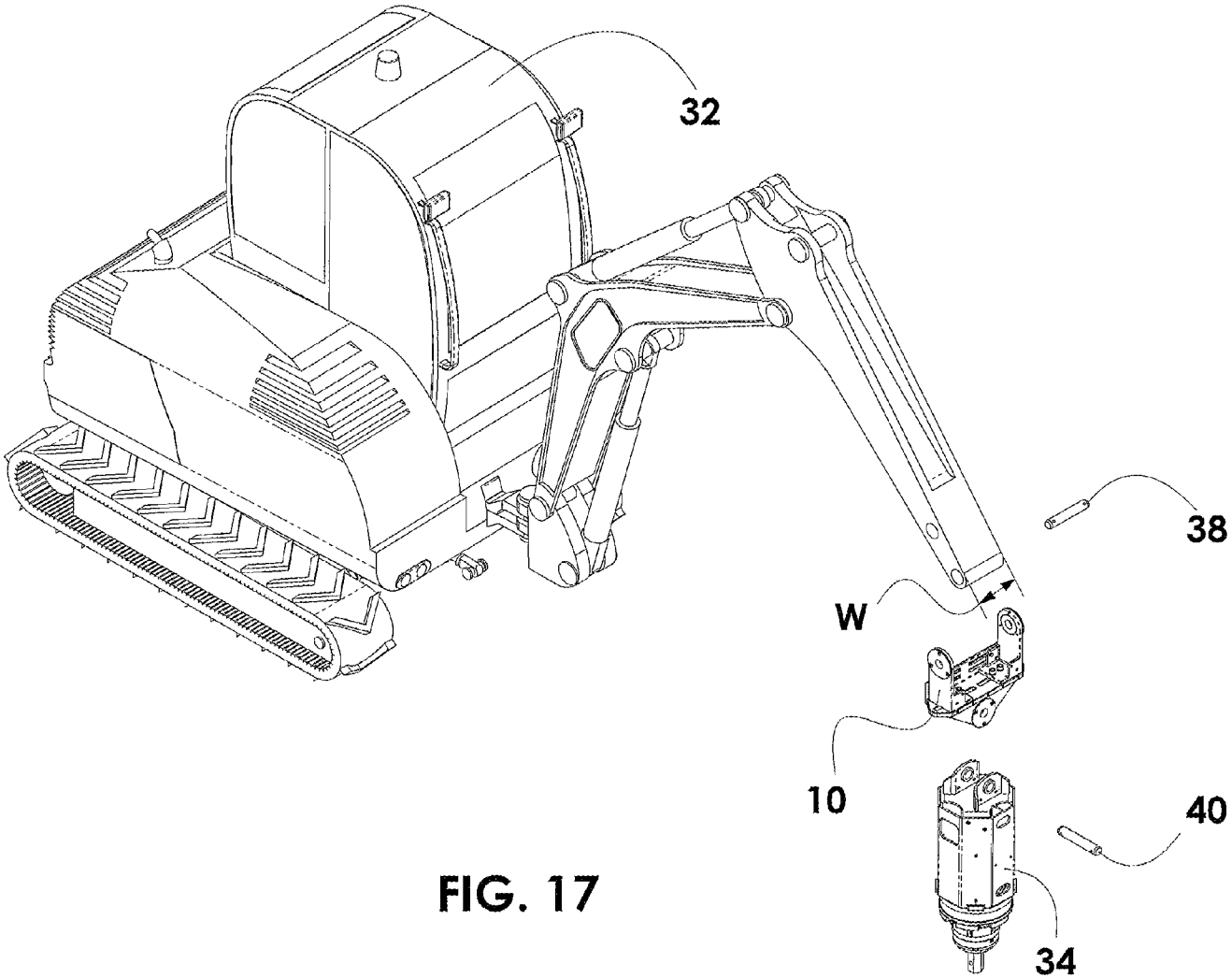
FIG. 17 is an exploded view showing how the coupler combines the boom of a prime mover to a rotary auger motor.

FIGS. 12-15 show the adjustable coupler being used to combine a mobile attachment device 34 to a prime mover vehicle 32. As described above, the ear portions 21 of the brackets 10A-10D as well as the frame 12 (in some embodiments) include openings adapted to combine with either a mobile attachment device or a prime mover vehicle. In one embodiment, the openings are adapted to receive pins 38, 40 like the ones shown in FIGS. 14, 15 and 17.

To use the assembly, a user takes one of the adjustable coupler assemblies described above. A proper distance between the brackets is determined by measuring the length of the pin length 38, 40 or the distance between pins 38, 40 on one of the prime mover vehicle 32 and the mobile attachment device 34. The measurement is taken at the pin end of the prime mover vehicle 32/mobile attachment device 34. For example, in FIG. 17, the distance W is measured at the pin end of the boom/arm of the prime mover vehicle 32 to determine how far apart to set the brackets 10A, 10B. The brackets are adjusted to that width by sliding them along the frame 12 then secured in place by tightening the fasteners 22 against the first and second rails 14, 16. The pin 38 from the prime mover vehicle's attachment is then secured through the openings in the brackets 10A, 10B so that pin 38 passes through the boom and the brackets 10A, 10B. The pin 38 is secured in place using any suitable locking means such as a cotter pin. The pin 40 from the mobile attachment device 34 is secured through other openings in the frame 12 (which may be the second bracket pair in some embodiments) and secured with a locking means such as a cotter pin so that the coupling assembly attaches the mobile attachment device 34 to the prime mover vehicle 32. The coupler assembly is attached to the mobile attachment device 34 either before or after the coupler assembly is attached to the prime mover vehicle 32.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is as follows:

1. An adjustable coupler assembly for connecting a first object to a second object, said assembly comprising:

a frame having a first rail combined with a second rail, wherein the first rail includes an elongated opening, wherein the frame is adapted to connect with the first object, and wherein the first rail and the second rail intersect at an angle;

a first bracket slidably combined with the frame along the elongated opening in the first rail; and a second bracket slidably combined with the frame along the elongated opening in the first rail;

wherein the first bracket and the second bracket are adapted to connect to the second object.

2. The adjustable coupler assembly of claim 1 further comprising a first guide member extending from the first bracket and into the elongated opening in the first rail and a second guide member extending from the second bracket and into the elongated opening in the first rail, the first guide member and the second guide member are slidable within the elongated opening.

3. The adjustable coupler assembly of claim 2 wherein the first guide member and the second guide member are fasteners.

4. The adjustable coupler assembly of claim 2 wherein the first rail includes two generally parallel elongated openings, each adapted to receive a guide member from the first bracket and the second bracket.

5. The adjustable coupler assembly of claim 1 further comprising an elongated opening in the second rail of the frame;

a third guide member extending from the first bracket and into the elongated opening in the second rail; and a fourth guide member extending from the second bracket and into the elongated opening in the second rail.

6. The adjustable coupler assembly of claim 1 wherein at least one of the first bracket and the second bracket include a base portion having an opening adapted to receive a guide member, an ear portion extending upwardly from the base portion and having an opening adapted to receive an attachment member, and a first side portion connecting the base portion and the ear portion.

7. The adjustable coupler assembly of claim 6 wherein at least one of the first and the second bracket further comprise a second side portion on a side of the ear portion that is opposite the first side portion, and the first side portion and the second side portion both include openings adapted to receive the guide members.

8. The adjustable coupler of claim 6 further comprising a bushing secured to the ear portion to reduce the size of the opening in the ear portion.

9. The adjustable coupler assembly of claim 1 wherein the first object is a mobile attachment device.

10. The adjustable coupler assembly of claim 1 wherein the second object is a prime mover vehicle.

11. An adjustable coupler assembly for connecting a first object to a second object, said assembly comprising:

a frame having a first rail and a second rail intersecting at an angle so that the first rail and the second rail extend outwardly in different directions, wherein the first rail includes an elongated opening and the second rail includes an elongated opening, and wherein the frame is adapted to connect to the first object;

a first bracket having a first guide member extending therefrom adapted to be received by and slide within the elongated opening in the first rail and a second guide member extending therefrom adapted to be received by and slide within the elongated opening in the second rail; and a second bracket having a first guide member extending therefrom adapted to be received by and slide within the elongated opening in the first rail and a second guide member extending therefrom adapted to be received by and slide within the elongated opening in the second rail;

wherein the first bracket and the second bracket include attachment openings adapted to receive an attachment member for connecting to the second object.

12. The adjustable coupler assembly of claim 11 wherein at least one of the first bracket and the second bracket include a base portion having an opening adapted to receive a guide member, an ear portion extending upwardly from the base portion and having an opening adapted to receive the attachment member, and a first side portion connecting the base portion and the ear portion.

13. The adjustable coupler assembly of claim 12 wherein at least one of the first and the second bracket further comprise a second side portion on a side of the ear portion that is opposite the first side portion, and the first side portion and the second side portion both include openings adapted to receive the guide members.

14. The adjustable coupler of claim 12 further comprising a bushing secured to the ear portion to reduce the size of the opening in the ear portion.

15. The adjustable coupler assembly of claim 11 wherein the first object is a mobile attachment device.

16. The adjustable coupler assembly of claim 11 wherein the second object is a prime mover vehicle.

17. The adjustable coupler assembly of claim 11 wherein the angle that the first rail intersects the second rail is about ninety degrees.

18. An adjustable coupler assembly for connecting a first object to a second object, said assembly comprising:

a frame having a first rail extending a first direction, a third rail extending in a second direction, and a second rail connecting the first rail and the third rail, wherein the first rail, second rail, and third rail each include an elongated opening;

a first bracket and a second bracket extending from the frame in the first direction and each having a first guide member extending therefrom adapted to be received by and slide within the elongated opening in the first rail and a second guide member extending therefrom adapted to be received by and slide within the elongated opening in the second rail, wherein the first bracket and the second bracket each include attachment openings adapted to receive one or more members for connecting to the first object; and a third bracket and a fourth bracket extending from the frame in the second direction and each having a first guide member extending therefrom adapted to be received by and slide within the elongated opening in the third rail and a second guide member extending therefrom adapted to be received by and slide within the elongated opening in the second rail, wherein the third bracket and the fourth bracket each include attachment openings adapted to receive one or more members for connecting to a second object.

19. The adjustable coupler assembly of claim 18 wherein the first object is a mobile attachment device.

20. The adjustable coupler assembly of claim 18 wherein the second object is a prime mover vehicle.

21. The adjustable coupler assembly of claim 18 wherein the second rail includes a first generally planer portion spaced from a second planer portion, each planer portion having an elongated opening therein, wherein the second guide member from the first bracket is received by the elongated opening in the first planer portion and the second guide member from the third bracket is received by the elongated opening in the second planer portion.

22. The adjustable coupler assembly of claim 18 wherein at least one of the brackets includes a base portion having an opening adapted to receive a guide member, an ear portion extending upwardly from the base portion and having an opening adapted to receive an attachment member, and a first side portion connecting the base portion and the ear portion.

23. The adjustable coupler assembly of claim 22 wherein at least one of the brackets further comprises a second side portion on a side of the ear portion that is opposite the first side portion, and the first side portion and the second side portion both include openings adapted to receive the guide members.

24. The adjustable coupler of claim 22 further comprising a bushing secured to the ear portion to reduce the size of the opening in the ear portion.

* * * * *